US007673940B2

(12) United States Patent
Fritz et al.

(10) Patent No.: US 7,673,940 B2
(45) Date of Patent: Mar. 9, 2010

(54) HEIGHT-ADJUSTMENT MECHANISM FOR JUVENILE SEAT

(75) Inventors: Ward Fritz, Chelsea, MA (US); Richard M. Bastien, Cumberland, RI (US); John Ristuccia, Plainville, MA (US); Andrew W. Marsden, Hingham, MA (US)

(73) Assignee: Cosco Management, Inc., Wilmington, DE (US)

( * ) Notice: Subject to any disclaimer, the term of this patent is extended or adjusted under 35 U.S.C. 154(b) by 202 days.

(21) Appl. No.: 11/873,335

(22) Filed: Oct. 16, 2007

(65) Prior Publication Data

US 2008/0179931 A1 Jul. 31, 2008

Related U.S. Application Data

(60) Provisional application No. 60/829,688, filed on Oct. 17, 2006.

(51) Int. Cl.
*A47C 1/08* (2006.01)

(52) U.S. Cl. ..... 297/256.11; 297/311; 297/344.12; 297/344.8; 297/250.1

(58) Field of Classification Search ..... 297/311, 297/344.12, 344.18, 250.1, 256.11
See application file for complete search history.

(56) References Cited

U.S. PATENT DOCUMENTS 2,615,499 A * 10/1952 De Loss ..... 297/325
4,521,052 A 6/1985 Cone
4,807,928 A 2/1989 Cone
4,842,331 A 6/1989 Waples
5,474,355 A * 12/1995 Lerner et al. ..... 297/36
5,507,550 A 4/1996 Maloney
5,526,537 A * 6/1996 Conrad ..... 4/483
5,755,489 A * 5/1998 Rossman et al. ..... 297/338
5,810,432 A 9/1998 Haut et al.
5,823,615 A 10/1998 Haut
5,951,102 A 9/1999 Poulson et al.
6,000,750 A * 12/1999 Rossman et al. ..... 297/2
6,050,643 A 4/2000 Kain et al.
6,299,247 B1 * 10/2001 Meeker et al. ..... 297/137
6,416,124 B1 7/2002 Chen et al.
6,419,312 B1 7/2002 Flannery et al.
6,692,070 B1 2/2004 Hou et al.
6,832,813 B2 * 12/2004 Tomas et al. ..... 297/250.1
7,032,970 B1 * 4/2006 Kharat ..... 297/256.11
7,104,603 B2 * 9/2006 Keegan et al. ..... 297/256.13
7,328,941 B2 * 2/2008 Asbach et al. ..... 297/153
7,387,337 B2 * 6/2008 Keegan et al. ..... 297/256.13
2003/0067198 A1 * 4/2003 Treen et al. ..... 297/250.1
2003/0151285 A1 * 8/2003 Keegan et al. ..... 297/256.13

* cited by examiner

*Primary Examiner*—Laurie K Cranmer
(74) *Attorney, Agent, or Firm*—Barnes & Thornburg

(57) ABSTRACT

A juvenile seat includes a seat base mounted for up-and-down movement on an underlying foundation. A lock is provided to set the elevation of the seat base relative to the foundation.

18 Claims, 9 Drawing Sheets

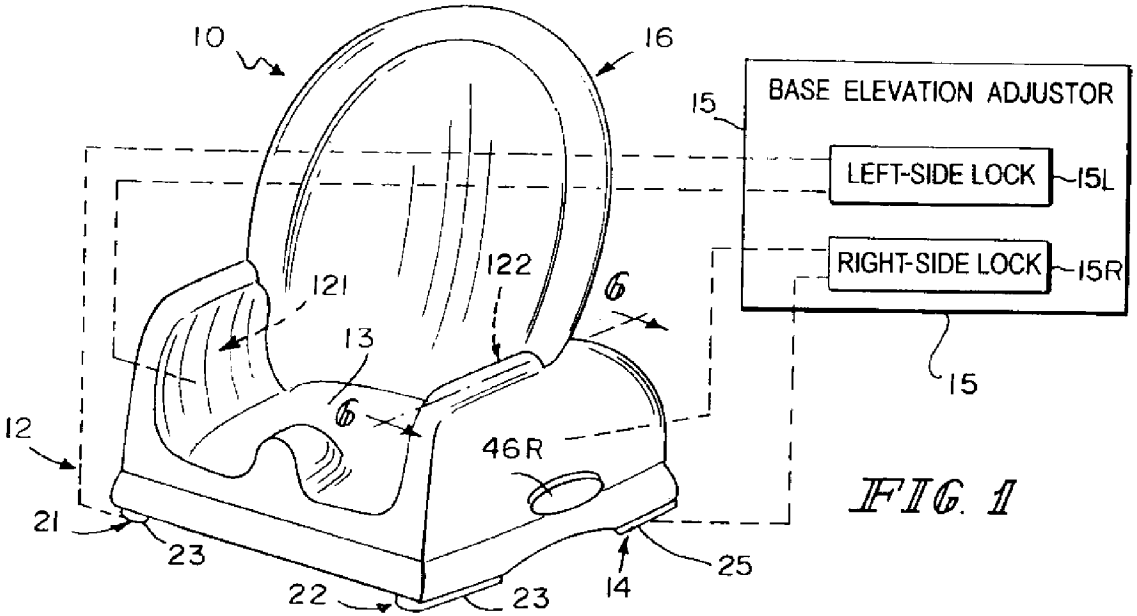
FIG. 1
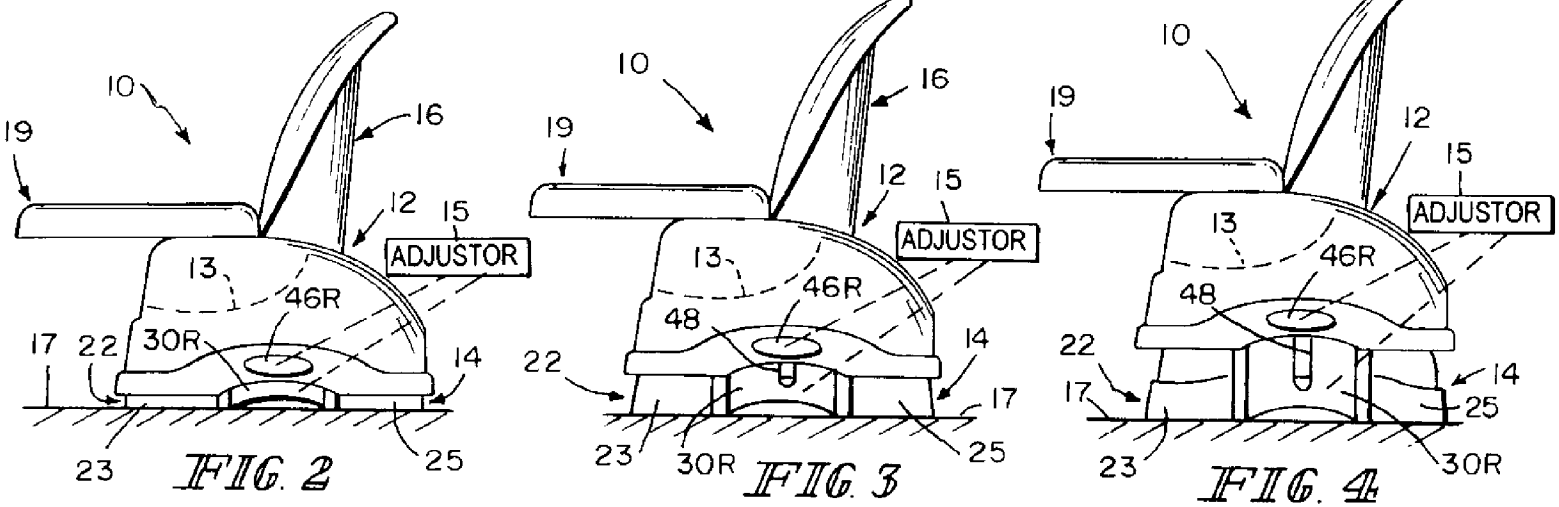
FIG. 2
FIG. 3
FIG. 4

HEIGHT-ADJUSTMENT MECHANISM FOR JUVENILE SEAT

This application claims priority under 35 U.S.C. §119(e) to U.S. Provisional Application Ser. No. 60/829,688, filed Oct. 17, 2006, which is expressly incorporated by reference herein.

BACKGROUND

The present disclosure relates to juvenile seats, and particularly to seats that can be raised and lowered. More particularly, the present disclosure relates to an adjustment mechanism for changing the elevation of the juvenile seat relative to a surface underlying the juvenile seat.

SUMMARY

A juvenile seat includes a seat base mounted for up-and-down movement on an underlying foundation. A base elevation adjustor is provided to lock the seat base to the foundation in any of several elevated positions.

In illustrative embodiments, the foundation includes a left pillar inserted into a left pillar-receiving chamber formed in the seat base and a separate right pillar inserted into a right pillar-receiving chamber formed in the seat base. The base elevation adjustor includes first means for selectively locking the seat base to the right pillar and second means for selectively locking the seat base to the left pillar.

In illustrative embodiments, the seat base includes a guide rail arranged to extend into a channel formed in one of the pillars to govern up-and-down movement of the seat base relative to that pillar. The base elevation adjustor is used to lock the seat base to the left and right pillars in either a low-elevation, mid-elevation, or high-elevation position relative to the surface underlying and supporting the left and right pillars to establish the elevation of the seat base relative to the pillars Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 1 is a perspective view of a juvenile booster seat provided with a height-adjustment feature in accordance with the present disclosure, the juvenile booster seat comprising a hollow seat base mounted for up-and-down movement on a foundation underlying and extending into a downwardly opening cavity formed in the seat base, a base elevation adjustor coupled to the seat base and to the underlying foundation, and a backrest coupled to the seat base for up-and-down movement therewith relative to the foundation;

FIG. 2 is a side elevation view of the juvenile booster seat of FIG. 1 showing a feeding tray mounted on the seat base and the seat base anchored to the foundation to lie in a "lowest-elevation" position relative to an underlying surface supporting the foundation;

FIG. 3 is a side elevation view similar to FIG. 2 showing the seat base anchored to the foundation to lie in a "middle-elevation" position relative to the underlying surface;

FIG. 4 is a side elevation view similar to FIGS. 2 and 3 showing the seat base anchored to the foundation to lie in a "highest-elevation" position relative to the underlying surface;

DETAILED DESCRIPTION

Figure 5A:
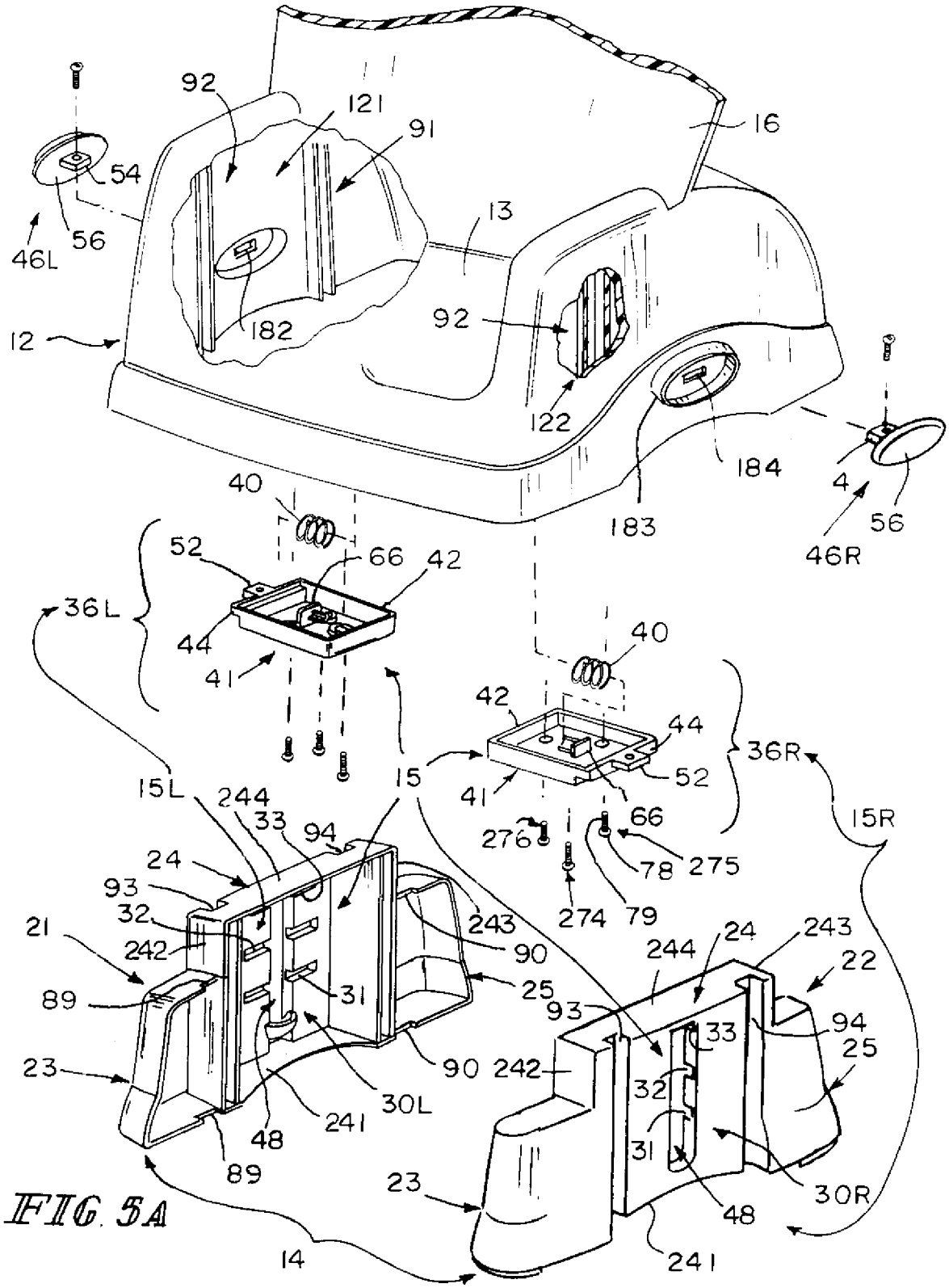
FIG. 5A is an exploded perspective assembly view of the juvenile booster seat of FIGS. 1-4 showing (from top to bottom) a portion of a backrest mounted on the hollow seat base, left and right base retainers included in the base elevation adjustor (each base retainer including a retainer spring and a retainer plate having a base anchor), and a foundation including left and right pillars and also showing that a vertical center elevation plate is included in each pillar and formed to include lower, middle, and upper anchor sockets.

A juvenile seat 10 in accordance with the present disclosure includes a seat base 12 formed to include a seat bottom 13 and mounted on an underlying foundation 14, a base elevation adjustor 15 that functions to "lock" seat base 12 to foundation 14 in any of several "elevated" positions, and a backrest 16 arranged to extend upwardly from seat base 12 as shown, for example, in FIG. 1. Seat base 12 is mounted for up-and-down movement relative to underlying foundation 14 once base elevation adjustor 15 is "unlocked" to change the elevation of seat bottom 13 relative to a "ground" surface 17 underlying foundation 14 as shown, for example, in FIGS. 2-4. Illustrative components included in base elevation adjustor 15 are shown in FIG. 5. Use of base elevation adjustor 15 to change the elevation of seat base 12 relative to underlying foundation 14 is shown in FIGS. 6-17. In illustrative embodiments, juvenile seat 10 also includes a feeding tray 19 coupled to seat base 12 as suggested in FIGS. 2-4.

In an illustrative embodiment shown in FIG. 5A, foundation 14 includes left and right pillars 21, 22. Seat base 12 includes a left pillar-receiving chamber 121 located along a left side of seat bottom 13 and a right pillar-receiving chamber 122 located along a right side of seat bottom 13. As suggested in FIGS. 5C and 5D, left pillar 21 is sized to be moved upwardly into left pillar-receiving chamber 121 through an opening provided on the underside of scat base 12 during assembly of juvenile seat 10. Likewise, right pillar 22 fits into right pillar-receiving chamber 122 as also suggested in FIGS. 5C and 5D.

Each pillar 21, 22 includes a front footing 23, a rear footing 25, and a plate frame 24 coupled to and arranged to lie between the front and rear footings 23, 25 as suggested in FIG. 5A. Each plate frame 24 includes a laterally extending floor 241 extending between front and rear footings 23, 25, a vertical front side wall 242 coupled to front footing 23 and one end of floor 241, a vertical rear side wall 243 coupled to rear footing 25 and another end of floor 241, and a ceiling 244 coupled to top ends of front and rear side walls 242, 243 and arranged to lie in spaced-apart parallel relation to floor 241 as shown, for example, in FIGS. 5A and 6. (It should be noted that many reinforcing walls included in pillars 21, 22 and shown, for example in FIG. 5C, have been omitted in FIGS. 5A and 6-17 to enhance the clarity of those drawings.)

As suggested in FIGS. 2-4, while left and night pillars 21, 22 of foundation 14 remain in stable positions on ground surface 17, the elevation of seat bottom 13 included in seat base 12 can be changed by a caregiver by raising and lowering seat base 12 relative to left and right pillars 21, 22. Base elevation adjustor 15 is operated by the caregiver to lock seat base 12 to left and right pillars 21, 22 to establish the desired elevation of seat bottom 13 relative to ground surface 17. A caregiver also can operate base elevation adjustor 15 to unlock seat base 12 from left and right pillars 21, 22 to allow up-and-down movement of seat base 12 relative to foundation 14.

In the illustrated embodiment, base elevation adjustor 15 includes a left-side lock 15L comprising a vertical center elevation plate 30L coupled to frame 24 of left pillar 21 and a left base retainer 36L as shown, for example, in FIG. 5A. Base elevation adjustor 15 also includes a right-side lock 11R comprising a vertical center elevation plate 30R coupled to frame 24 of right pillar 22 and a right base retainer 36R as shown, for example, in FIGS. 5A and 6-8.

A caregiver locks seat base 12 in a selected elevated position relative to foundation 14 by (1) causing left base retainer 36L to mate with vertical center elevation plate 30L in left pillar 21 and (2) causing right base retainer 36R to mate with vertical center elevation plate 30R in right pillar 22. One illustrative use of this "technique" as applied to right-side lock 15R and vertical center elevation plate 30R coupled to right pillar 22 is shown, for example, in FIGS. 6-17. In this sequence, seat base 12 is "locked" to foundation 14 to remain in a "lowest-elevation" position in FIGS. 6-8 and in a "middle-elevation" position in FIGS. 15-17. Also in this sequence, seat base 12 is "unlocked" as suggested in FIGS. 9-11 so that seat base 12 is free to move upwardly from the lowest-elevation position to the middle-elevation position as suggested in FIGS. 12-14.

Figure 5B:
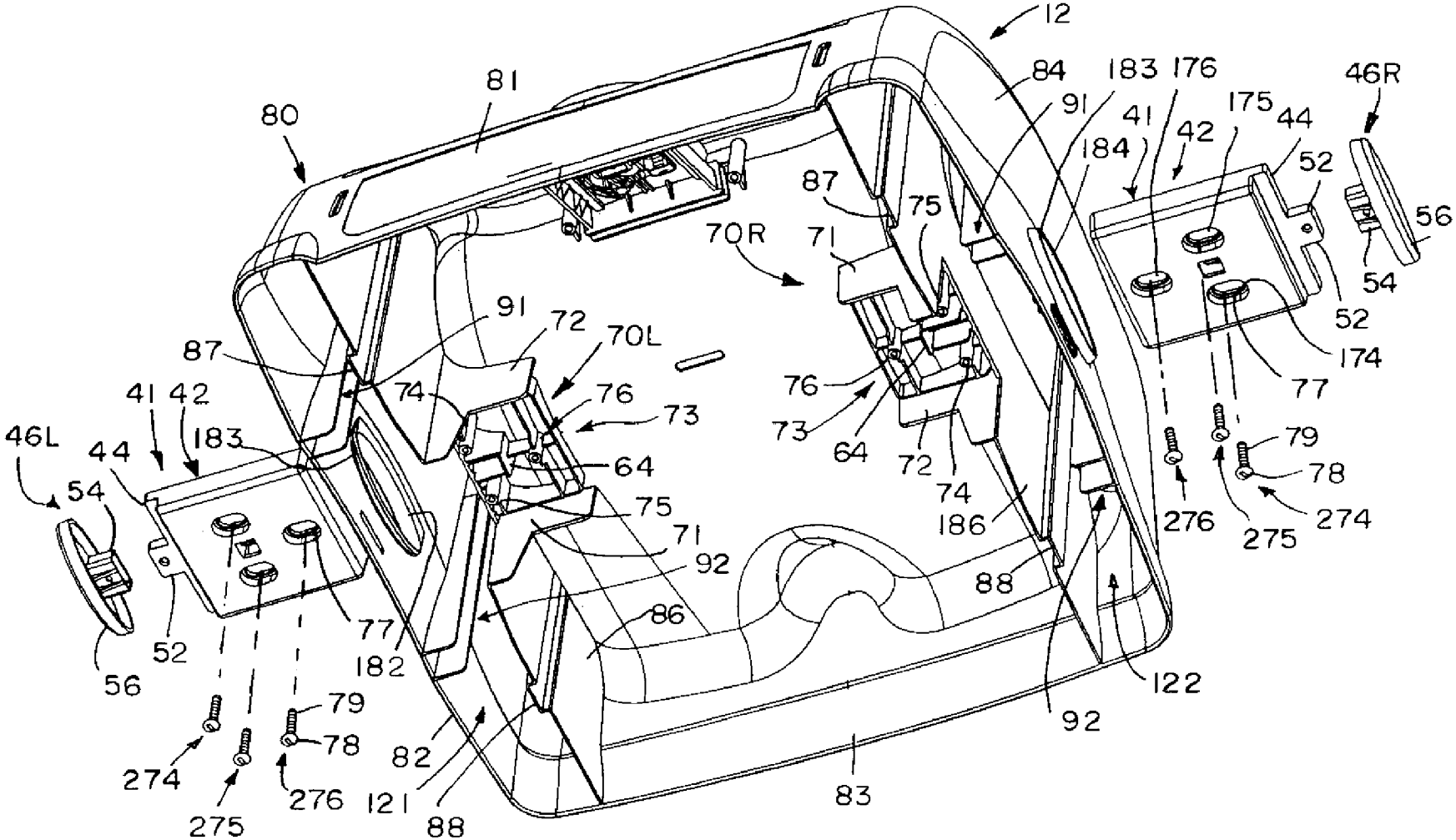
FIG. 5B is an enlarged perspective view of the underside of the seat base showing spaced-apart downwardly opening left and right pillar-receiving chambers formed in the seat base and included in the downwardly opening cavity formed in the seat base and showing a left retainer-actuator button and a left base retainer on the "left side" of the seat base and a right retainer-actuator button and a right base retainer on the "right side" of the seat base.
Figure 5C:
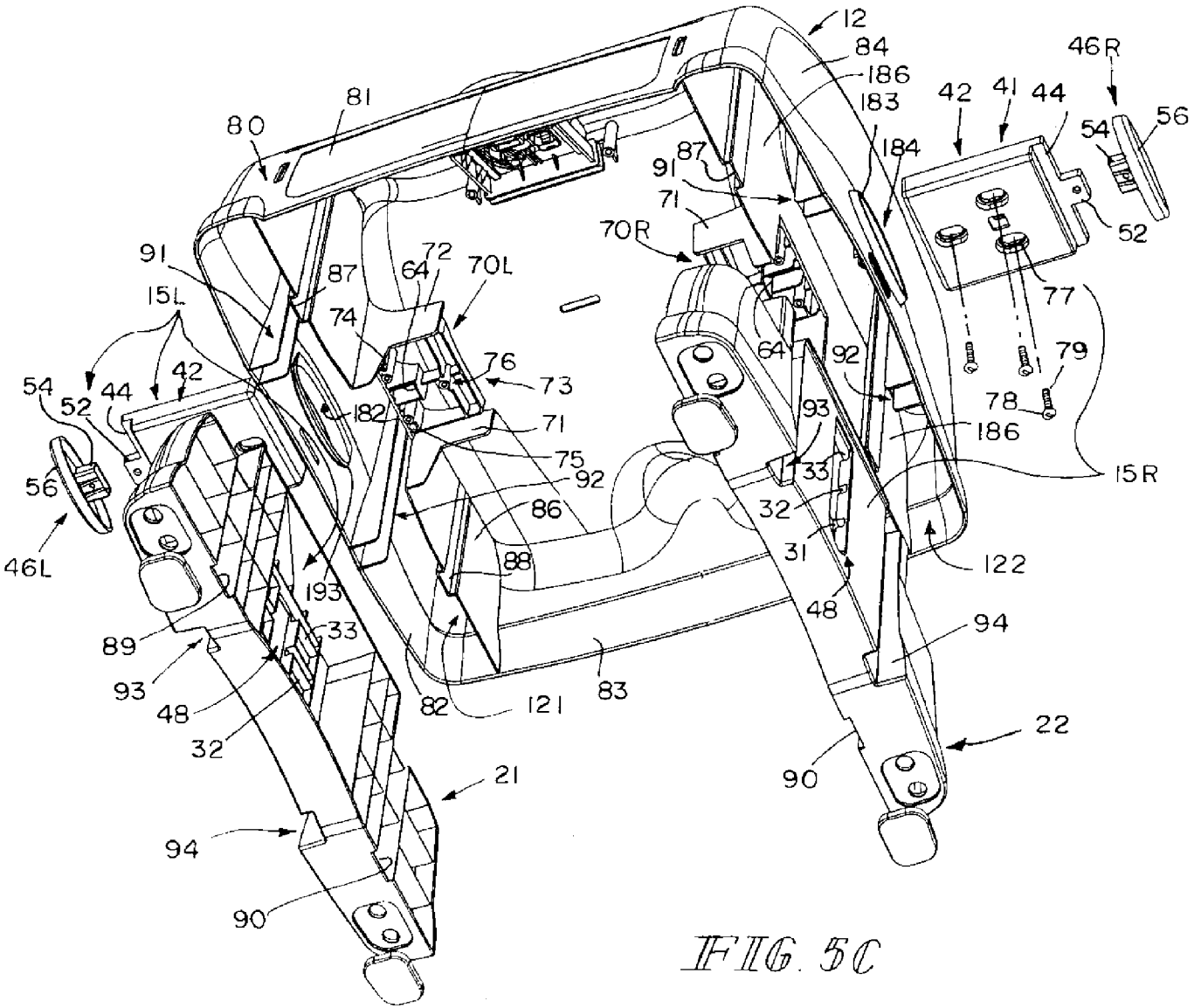
FIG. 5C is a view similar to FIG. 5B showing upward movement of a left pillar in the foundation toward an opening into the left pillar-receiving chamber formed in the seat base and upward movement of a right pillar in the foundation toward an opening into the right pillar-receiving chamber formed in the seat base.
Figure 5D:
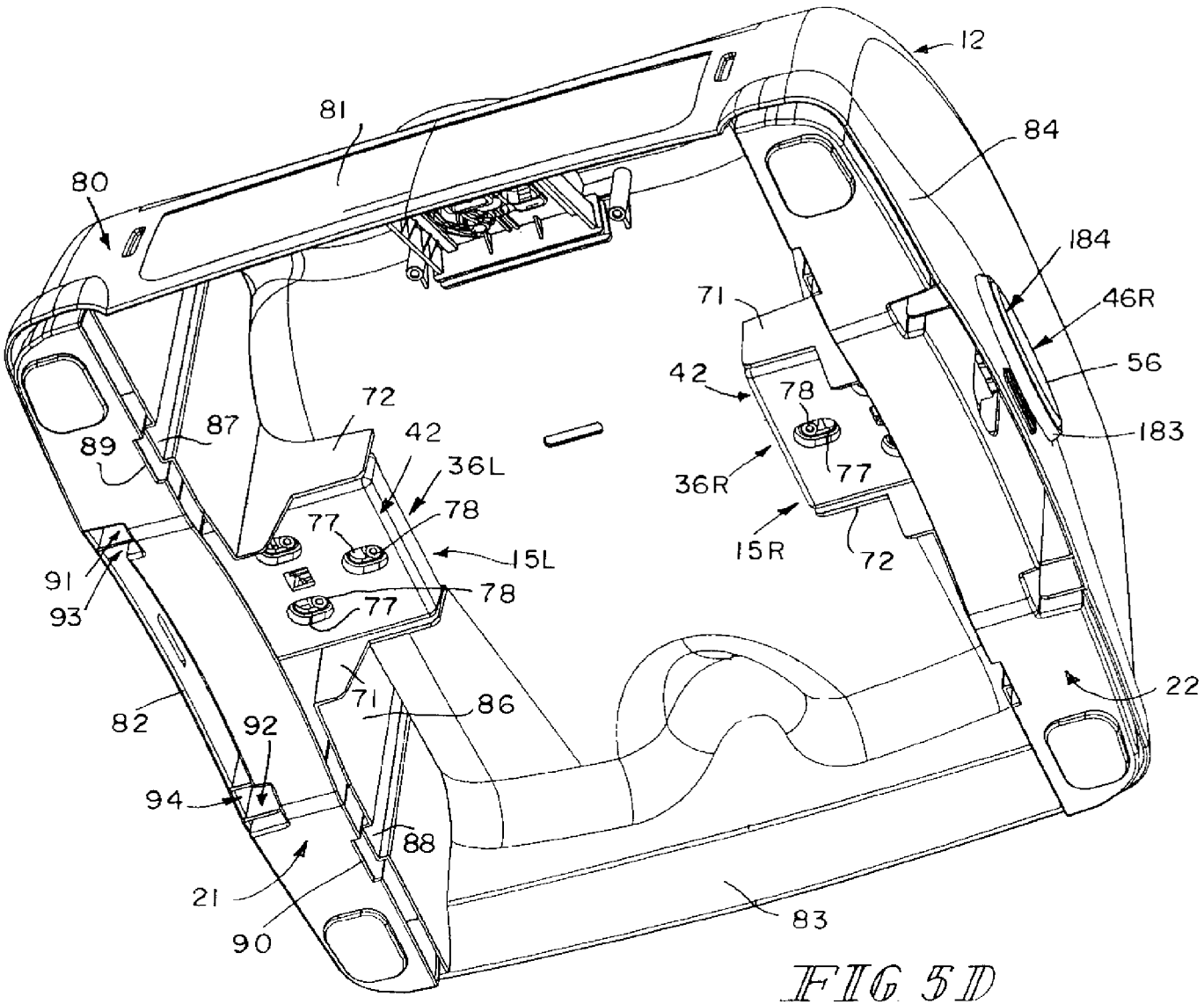
FIG. 5D is a view similar to FIG. 5C after placement of the left and right pillars and the left and right base retainers and retainer-actuator buttons in mounted positions on the seat base and showing the seat base anchored to the foundation to lie in the lowest-elevation position shown in FIGS. 1 and 2.
Figure 6:
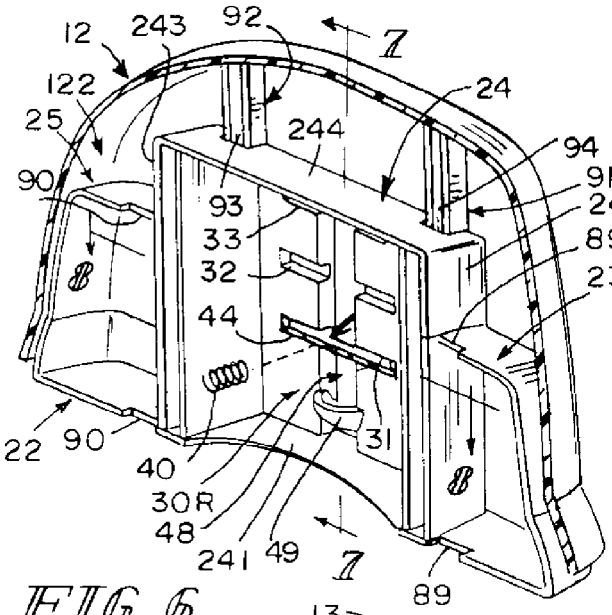
FIG. 6 is a perspective view of portions of the seat base and foundation taken generally along line 6-6 of FIG. 1, with portions broken away, showing the vertical center elevation plate included in the base elevation adjustor and coupled to the right pillar and showing the base anchor of the right base retainer inserted into the lower anchor socket formed in the center elevation plate of the base elevation adjustor coupled to the right pillar of the foundation to anchor the seat base to the right pillar of the foundation in the lowest-elevation position shown in FIGS. 1 and 2.

In illustrative embodiments, shown for example in FIGS. 5A and 6, each base retainer 36L, 36R includes a retainer spring 40 and a retainer latch 41 including a retainer plate 42 and an outwardly projecting base anchor 44 coupled to retainer plate 42. A left retainer-actuator button 46L is associated with left base retainer 36L and a right retainer-actuator button 46R is associated with right base-retainer 36R as suggested in FIGS. 5A-5D.

Left vertical center elevation plate 30L is coupled to frame 24 of left pillar 21. Right vertical center elevation plate 30R is coupled to frame 24 of right pillar 22. Each center elevation plate 30L, 30R is formed to include at least one anchor socket (e.g., 31, 32, 33) configured to provide means for receiving outwardly projecting base anchor 44 of retainer latch 41 therein to retain seat base 12 in a predetermined elevation position relative to foundation 14. In an illustrative embodiment, each center elevation plate 30L, 30R is formed to include a lower anchor socket 31, a middle anchor socket 32, and an upper anchor socket 33. Each anchor socket 31, 32, 33 is formed to include an anchor-receiving opening facing inwardly toward the outwardly projecting base anchor 44 included in retainer latch 41 of the companion base retainer (e.g., 36L or 36R).

Each center elevation plate 30L, 30R is also formed to include a vertical travel channel 48 arranged to intersect (e.g., bisect) anchor sockets 31, 32, and 33 as suggested in FIGS. 5A and 6. Each center elevation plate 30L, 30R also includes an inwardly bowed support block 49 spanning a bottom portion of each vertical travel channel 48 and configured to provide barrier means located below all of anchor slots 31, 32, 33 for mating with an underside of retainer plate 42, as suggested in FIG. 7, when base anchor 44 of a companion base retainer (e.g., 36R) is removed from lowest anchor slot 31 to limit further downward movement of that base retainer below lowest anchor slot 31 toward underlying ground surface 17. In an illustrative embodiment, vertical travel channel 48 extends upwardly from floor 241 of frame 24 to ceiling 244 of frame 24 as suggested in FIGS. 5A and 6.

Each base retainer 36L, 36R also includes an outwardly projecting button mount 52 cantilevered to a forward edge of base anchor 44 of retainer latch 41 as suggested in FIGS. 5A and 5B. Button mount 52 is configured to mate with an inwardly projecting mount fixture 54 included in a companion retainer-actuator button 46L or 46R. Button mount 52 is arranged to extend through the companion vertical travel channel 48 formed in center plate 30L or 30R to facilitate up-and-down movement of retainer-actuator button 46L or 46R along with its companion base retainer 36L or 36R relative to pillars 21, 22 in foundation 14 as suggested in FIGS. 2-4 and FIGS. 6-17.

Figure 7:
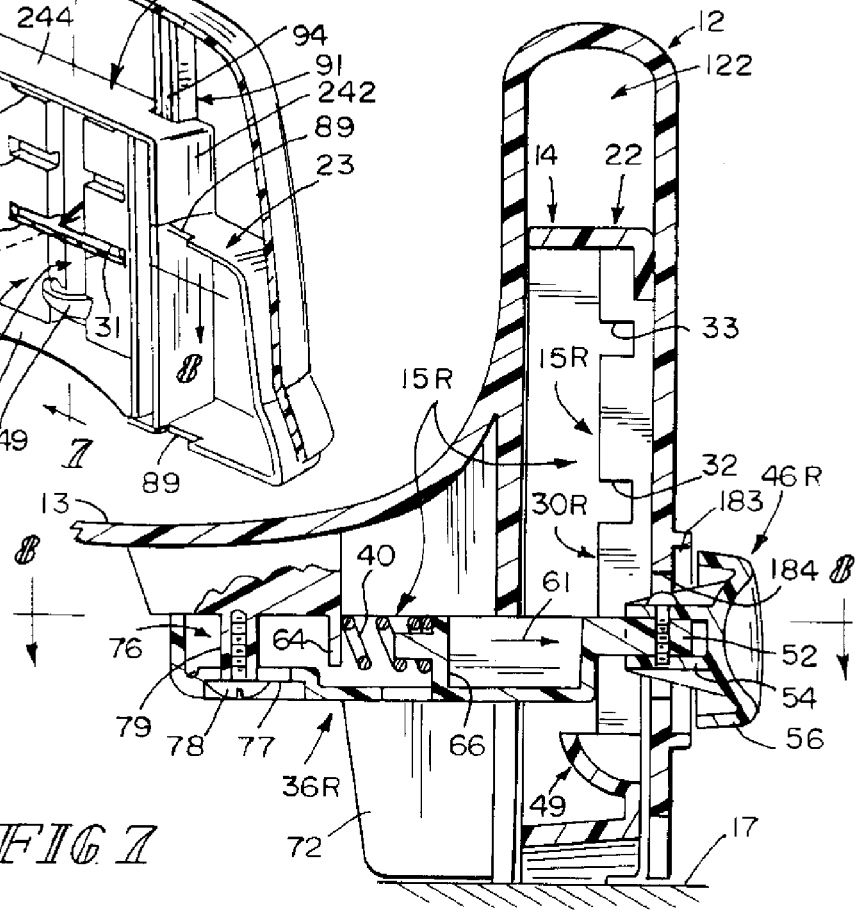
FIG. 7 is a sectional view taken along line 7-7 of FIG. 6.

In an illustrative embodiment shown in FIGS. 5B and 7, each retainer-actuator button 46L or 46R is a monolithic element comprising a mount fixture 54 cantilevered to the underside of an oblong finger pad 56. Suitable fasteners are used to fasten each button mount 52 to its companion mount fixture 54.

A spring 40 is included in each of left and right base retainers 36L, 36R and used as suggested in FIGS. 5A, 6, 7, and 8 to yieldably urge a companion retainer plate 42 in an "outward" direction 61 to cause the base anchor 44 coupled to that retainer plate 42 to mate with one of socket anchors 31, 32, and 33 formed in center elevation plate 30L or 30R mounted on frame 24 of left or right pillar 21 or 22 when that base anchor 44 is aligned in confronting relation with one of anchor sockets 31, 32, and 33. By manually pushing retainer-actuator button 46L or 46R in an opposite inward direction 62 (by pressing on finger pad 56) as suggested in FIGS. 10 and 11, that base anchor 44 included in retainer latch 41 can be moved inwardly to unmate with one of the socket anchors 31, 32, and 33 to allow up-and-down movement of seat base 12 relative to foundation 14 among the various "elevation" positions.

Figure 10:
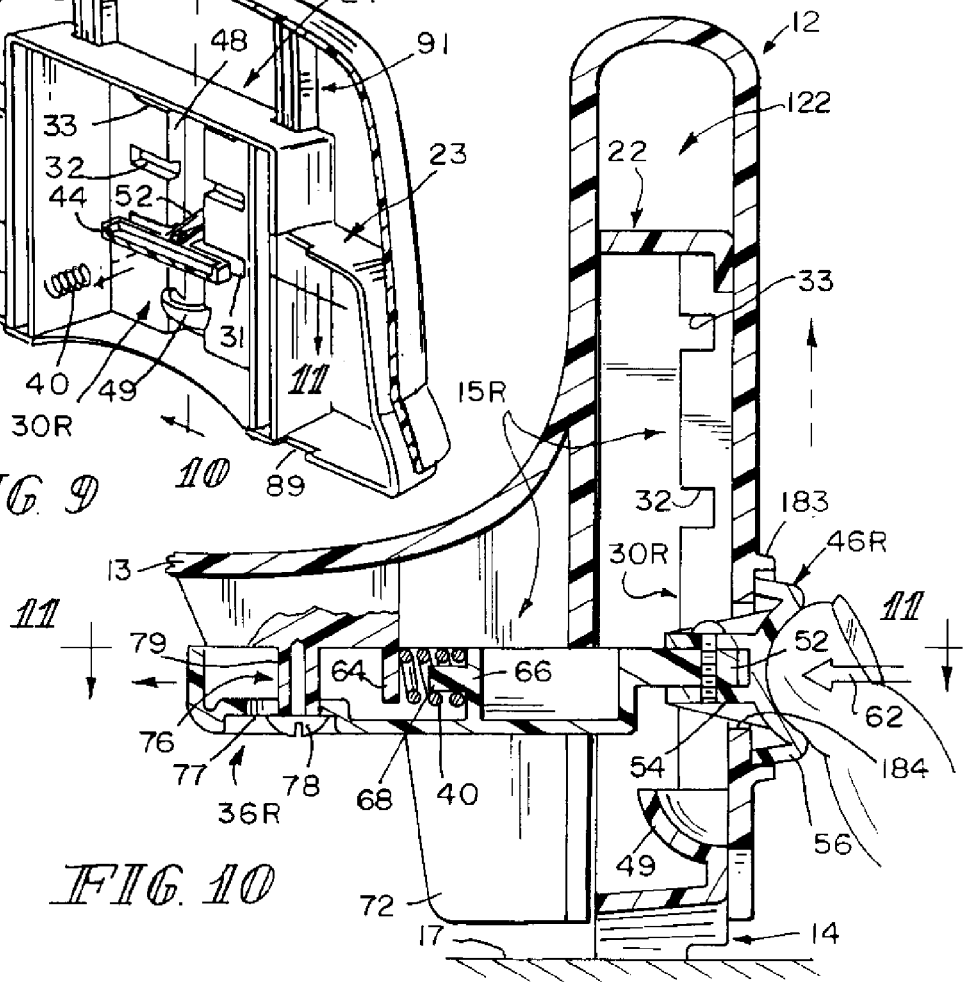
FIG. 10 is a sectional view taken along line 10-10 of FIG. 9.
Figure 11:
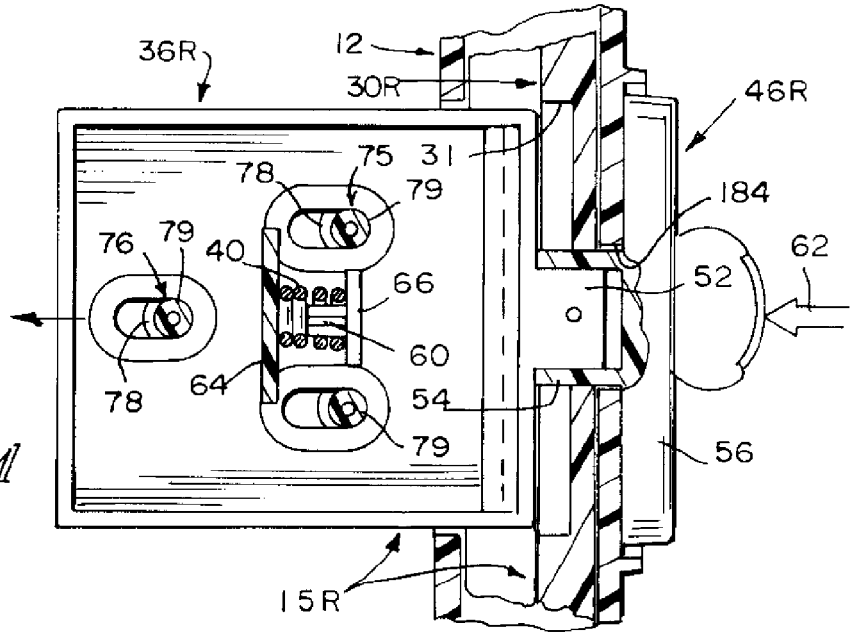
FIG. 11 is a sectional view taken along line 11-11 of FIGS. 9 and 10.
Figure 12:
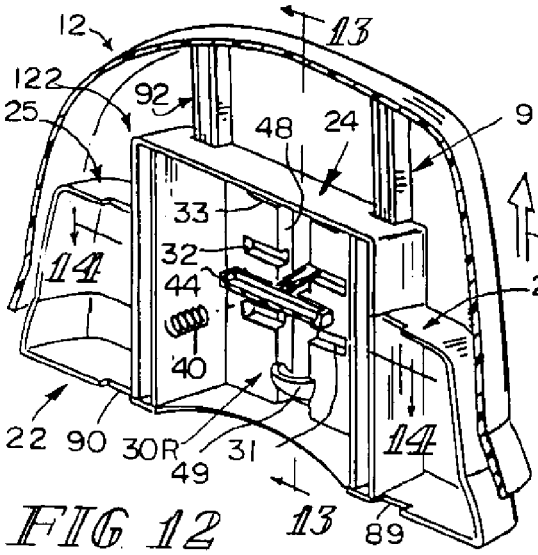
FIG. 12 is a perspective view similar to FIGS. 6 and 9, with portions broken away, showing upward movement of the seat base relative to one of the pillars of the foundation and away from the "ground" surface under the foundation to a point midway between the lower anchor socket and the middle anchor socket formed in the center elevation plate.

Each spring 40 is interposed between a companion fixed spring anchor wall 64 provided in seat base 12 and a movable spring anchor wall 66 provided in retainer plate 42 as shown best in FIGS. 5B, 10, and 11. Spring 40 generates an outwardly directed force that is applied to retainer plate 42 to urge retainer plate 42 (and the base anchor 44 coupled to retainer plate 42) in an outward direction relative to seat base 12 toward a companion center elevation plate 30L or 30R and anchor sockets 31, 32, 33 formed therein. In the illustrated embodiment, a coiled compression spring is provided to serve as spring 40 and an alignment post 68 is coupled to movable spring anchor wall 66 and arranged to extend into a central passage formed in coiled spring 40 as shown best in FIGS. 10 and 11.

The underside of seat base 12 is formed as suggested in FIG. 5B to include (1) left platform means 70L for supporting retainer latch 41 of left base retainer 36L for sliding movement toward and away from anchor sockets 31, 32, 33 formed in left center elevation plate 30L coupled to left pillar 21 and (2) right platform means 70R for supporting retainer latch 41 of right base retainer 36R for sliding movement toward and away from anchor sockets 31, 32, 33 formed in right center elevation plate 30R coupled to right pillar 22. Right platform means 70R is shown also in FIGS. 7, 10, 13, and 15. As suggested in FIG. 5B, each platform means 70L and 70R comprises first and second retainer guides 71, 72 arranged to lie in spaced-apart relation to one another and a retainer support 73 located therebetween. Retainer support 73 includes first, second, and third post mounts 74, 75, and 76 as shown, for example, in FIG. 5B. Each of post mounts 74, 75, and 76 is formed to include a downwardly opening fastener-receiving bore sized to receive a post 79 of a fastener therein.

Figure 8:
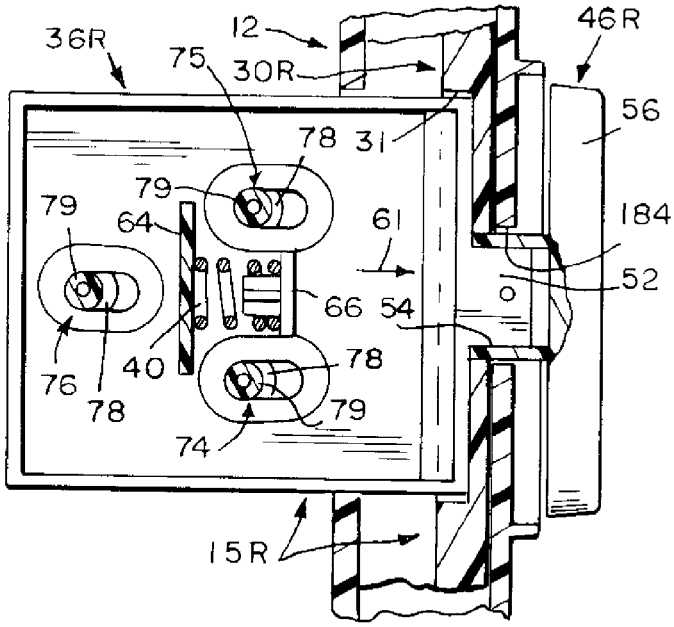
FIG. 8 is a sectional view taken along line 8-8 of FIGS. 6 and 7.
Figure 9:
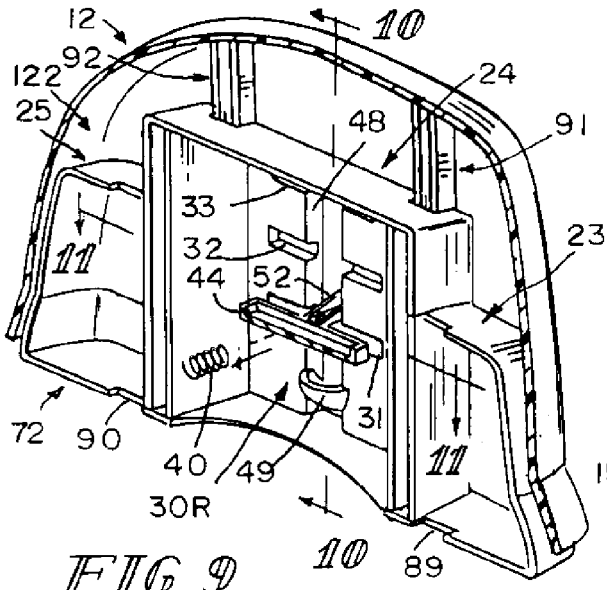
FIG. 9 is a perspective view similar to FIG. 6, with portions broken away, showing withdrawal of the base anchor of the right base retainer from the lower anchor socket formed in the center elevation plate of the base elevation adjustor coupled to the right pillar of the foundation to release the seat base so that it can be raised upwardly relative to the pillars of the foundation.

Each retainer plate 42 is formed to include oblong first, second, and third post-receiver slots 174, 175, and 176 as shown, for example, in FIGS. 5B and 8. A narrow head-support flange 77 is arranged to border an interior edge of each of post-receiver slots 174, 175, and 176 as suggested in FIGS. 5B, 7, and 8. First, second, and third "slide" fasteners 274, 275, and 276 are provided for each retainer plate 42 as suggested in FIG. 5B. Each slide fastener 274, 275, 276 includes a glide head 78 adapted to engage head-support flange 77 and a threaded post 79 coupled to glide head 78 and arranged to extend through one of the post-receiver slots 174, 175, or 176 and into a fastener-receiving bore formed in one of the post mounts 74, 75, or 76 to mate with seat base 12.

The glide head 78 of each slide fastener 274, 275, 276 is configured and arranged to mate with the head-support flange 77 associated with the companion post-receiver slot 174, 175, 176 as shown, for example, in FIGS. 5D, 16, 17, 19, and 20. In practice, each head-support flange 77 on the movable retainer plate 42 will "ride on" a flat surface of a companion stationary glide head 78 of a slide fastener 274, 275, 276 during movement of that retainer plate 42 relative to the stationary seat base 12 to lock and unlock seat base 12 to and from foundation 14. In effect, head-support flanges 77 and companion glide heads 78 cooperate to provide means for supporting a companion retainer plate 42 of the retainer latch 41 for inward and outward sliding movement relative to seat base 12 to cause base anchor 44 to mate and unmate with one of anchor sockets 31, 32, or 33 formed, for example, in a center elevation plate 30L or 30R included in foundation 14 as suggested in FIGS. 5D, 16, 17, 19, and 20.

Figure 13:
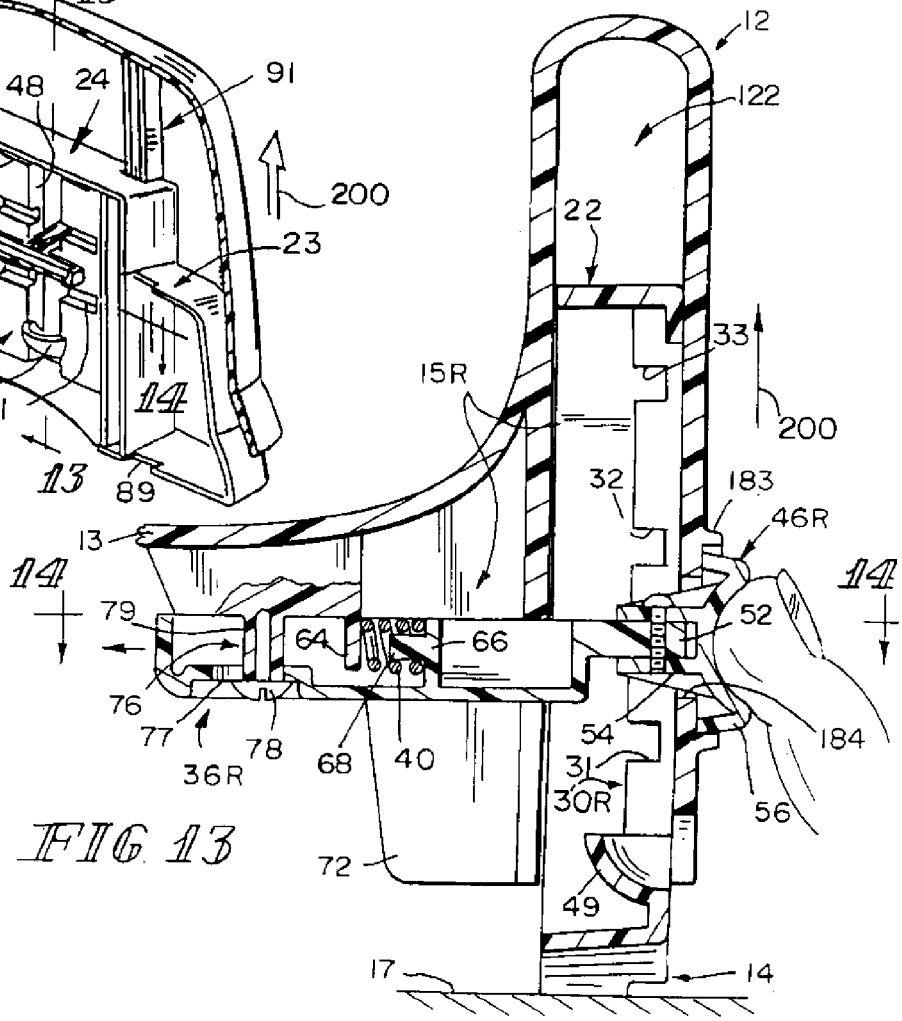
FIG. 13 is a sectional view taken along line 13-13 of FIG. 12.
Figure 14:
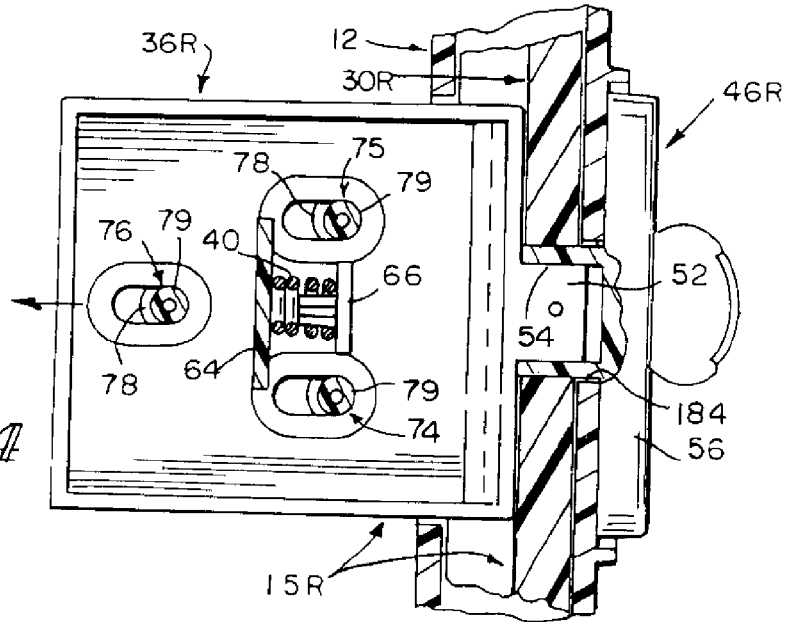
FIG. 14 is a sectional view taken along line 14-14 of FIGS. 12 and 13.
Figure 15:
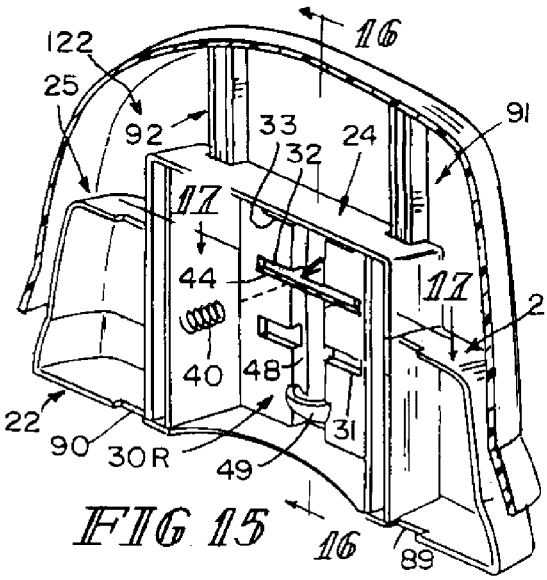
FIG. 15 is a perspective view similar to FIGS. 6, 9, and 12, with portions broken away, showing insertion of the base anchor of the right base retainer into the middle anchor socket formed in the center elevation plate of the base elevation adjustor coupled to the right pillar of the foundation to anchor the seat base to the foundation in the middle-elevation position shown in FIG. 3.
Figure 16:
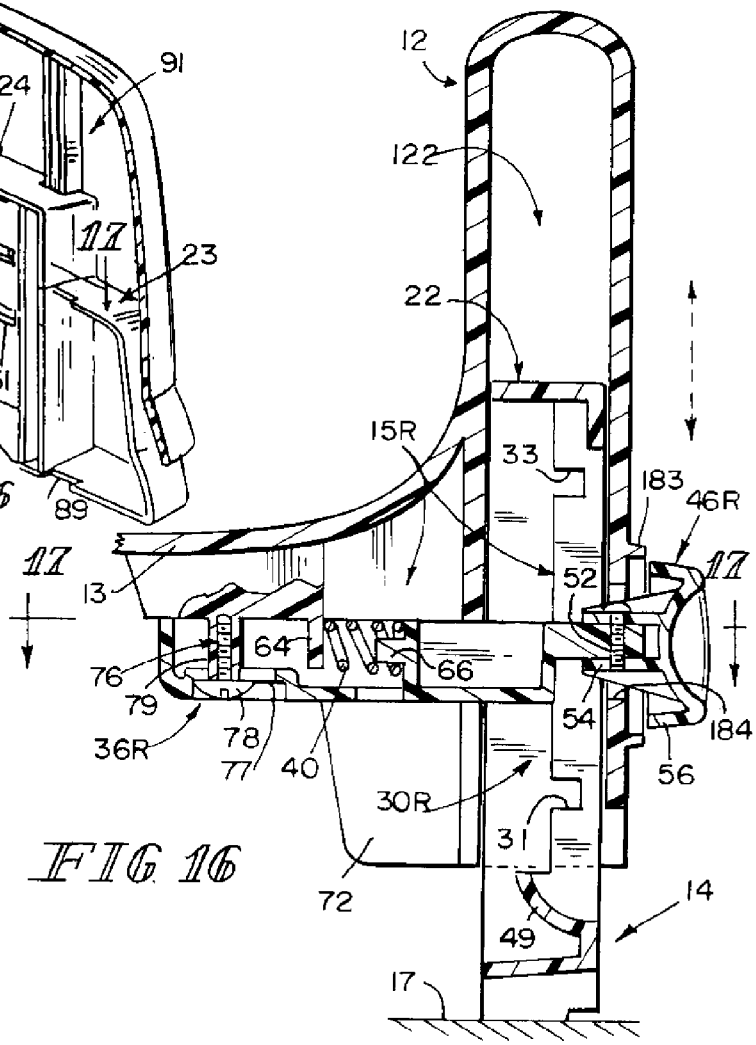
FIG. 16 is a sectional view taken along line 16-16 of FIG. 15.
Figure 17:
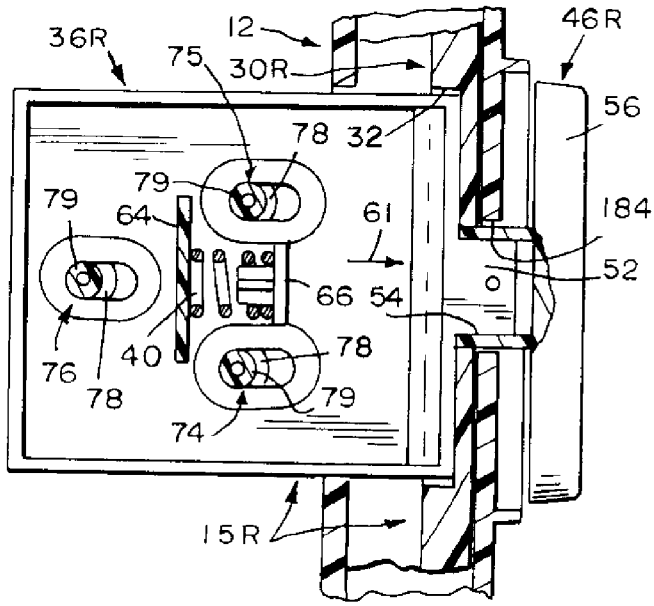
FIG. 17 is a sectional view taken along line 17-17 of FIGS. 15 and 16.

An illustrative underside of seat base 12 is shown best in FIG. 5B. Seat base 12 includes an endless outer rim 80 having, in sequence, a front wall 81, left side wall 82, rear wall 83, and a right side wall 84. Left side wall 82 is formed to include a button receiver aperture 182 opening into left pillar-receiving chamber 121 and right side wall 84 is formed to include a button receiver aperture 184 opening into right pillar-receiving chamber 122. Each button receiver aperture 182 and 184 is surrounded by a rim 183 that is configured and sized to receive one of the finger pads 56 therein as shown in FIGS. 5D, 10, and 13.

Seat base 12 also includes a left inner side wall 86 coupled to front and rear walls 81, 83 and arranged to lie in spaced-apart relation to left side wall 82 to define left pillar-receiving chamber 121 therebetween as shown in FIG. 5B. Each of first and second retainer guides 71, 72 included in left platform means 70L is coupled to left inner side wall 86 as shown in FIG. 5B.

Left inner side wall 86 is formed to include spaced-apart vertically extending front and rear guide rails 87, 88 arranged to extend into left pillar-receiving chamber 121. These front and rear guide rails 87, 88 extend into front and rear channels 89, 90 formed on an inward side of left pillar 21 as suggested in FIGS. 5C and 5D to provide one means for aligning, registering, and/or guiding relative movement between left pillar 21 and seat base 12 as the elevation of seat base 12 is changed relative to foundation 14. Forward and rearward guide rails 91, 92 are arranged to lie in spaced-apart location on an interior surface of left side wall 82 to locate button receiver aperture 182 therebetween. Forward and rearward guide rails 91, 92 are arranged to extend into forward and rearward channels 93, 94 formed in an outward side of left pillar 21 as suggested in FIGS. 5C and 5D to provide another means for aligning, registering, and/or guiding relative movement between left pillar 21 and seat base 12 as the elevation of seat base 12 is changed relative to foundation 14.

Seat base 12 also includes a right inner side wall 186 coupled to front and rear walls 81, 83 and arranged to lie in spaced-apart relation to right side wall 84 to define right pillar-receiving chamber 122 therebetween as shown in FIG. 5B. Each of first and second retainer guides 71, 72 included in right platform means 70R is coupled to right inner side wall 186 as shown in FIG. 5B.

Right inner side walls 186 is formed to include spaced-apart vertically extending front and rear guide rails 87, 88 arranged to extend into right pillar-receiving chamber 122. These front and rear guide rails 87, 88 extend into front and rear channels 89, 90 formed on an inward side of right pillar 22 as suggested in FIGS. 5C and 5D to provide one means for aligning, registering, and/or guiding relative movement between right pillar 22 and seat base 12 as the elevation of seat base 12 is changed relative to foundation 14. Forward and rearward guide rails 91, 92 are arranged to lie in spaced-apart location on an interior surface of right side wall 84 to locate button receiver aperture 184 therebetween. Forward and rearward guide rails 91, 92 are arranged to extend into forward and rearward channels 93, 94 formed in an outward side of right pillar 22 as suggested in FIGS. 5C and 5D to provide another means for aligning, registering, and/or guiding relative movement between right pillar 22 and seat base 12 as the elevation of seat base 12 is changed relative to foundation 14.

Seat base 12 is shown in a lowest-elevation position on foundation 14 in FIGS. 1, 2, and 6-8. In use, a caregiver will push inwardly in direction 62 on finger pad 52 of retainer-actuator button 46R as suggested in FIGS. 9-11 to cause base anchor 44 of right base retainer 36R to disengage anchor socket 31 formed in vertical center elevation plate 30R coupled to right pillar 22 of the foundation. (Retainer-actuator button 46L is also operated in the same manner.) Then the caregiver can raise seat base 12 upwardly in direction 200 away from ground surface 17 as suggested in FIGS. 10 and 13 so that seat base 12 moves relative to foundation 14 to reach the middle-elevation position shown in FIG. 16. At that stage, spring 40 urges right base retainer 36R to the right to engage base anchor 44 in middle anchor socket 32.

The invention claimed is:

1. A juvenile seat comprising a foundation including a left pillar and a right pillar, the left and right pillars being adapted to set on an underlying surface, a seat base mounted for up-and-down movement on the left and right pillars of the foundation, the seat base being formed to include a downwardly opening left pillar-receiving chamber, a downwardly opening right pillar-receiving chamber, and an upwardly facing seat bottom lying between the left and right pillar-receiving chambers, the left pillar of the foundation being arranged to extend upwardly into the left pillar-receiving chamber of the seat base, the right pillar of the foundation being arranged to extend upwardly into the right pillar-receiving chamber of the seat base, a base elevation adjustor providing lock means for selectively locking the seat base to the left pillar and for selectively locking the seat base to the right pillar to establish a desired elevation of the seat bottom relative to the underlying surface;

wherein the seat base includes an outer rim having, in sequence, a front side wall, a left side wall, a rear wall, and a right side wall, a left inner wall coupled to the front and rear walls and arranged to cooperate with the left side wall to define the left pillar-receiving channel therebetween, and a right inner wall coupled to the front and rear walls and arranged to cooperate with the right side wall to define the right pillar-receiving channel therebetween, wherein the right side wall includes spaced-apart forward and rearward guide rails, the forward guide rail is arranged to extend into the right pillar-receiving chamber and into a forward channel formed in the right pillar, the rearward guide rail is arranged to extend into the right pillar-receiving chamber and into a rearward channel formed in the right pillar and located in spaced-apart relation to the rearward channel, the right pillar is formed to include lower and upper anchor sockets situated in the right pillar-receiving chamber and arranged to open in a direction facing toward the left pillar and the lock means includes a right-side lock arranged to extend through the right pillar-receiving chamber into the lower anchor socket to link the seat base to the right pillar to support the seat bottom at a first elevation above the underlying surface and alternately into the upper anchor socket to link the seat base to the right pillar to support the seat bottom at a higher second elevation above the underlying surface, and the lower and upper anchor sockets are located in a space provided between the forward and rearward channels formed in the right pillar, and wherein the right pillar is formed to include a travel channel arranged to intersect the lower and upper anchor sockets and the right-side lock includes a right base retainer mounted for movement relative to the seat bottom to extend into a selected one of the lower and upper anchor sockets and a right retainer-actuator button located outside the right pillar-receiving chamber and arranged to extend through the travel channel to mate with the right base retainer to provide means for moving the right base retainer relative to the right pillar to engage and disengage the lower and upper anchor sockets.

2. The juvenile seat of claim 1, wherein the lock means includes a left-side lock coupled to the left pillar and to the seat base and a right-side lock coupled to the right pillar and to the seat base.

3. The juvenile seat of claim 2, wherein the right pillar includes a plate frame and the right-side lock includes a right elevation plate coupled to the plate frame of the right pillar, the right elevation plate is formed to include a lower anchor socket associated with a first elevation of the seat bottom above the underlying surface and an upper anchor socket associated with a higher second elevation of the seat bottom, the right-side lock also includes a right base retainer mounted for movement relative to the seat bottom toward the right elevation plate to extend into one of the lower and upper anchor sockets to retain the seat base in a predetermined elevation position relative to the foundation and away from the right elevation plate to exit the lower and upper anchor sockets to free the seat base for up-and-down movement relative to the right pillar of the foundation.

4. The juvenile seat of claim 3, wherein the right pillar further includes a front footing adapted to set on the underlying surface and a spaced-apart rear footing adapted to set on the underlying surface, the plate frame is arranged to lie between and interconnect the front and rear footings, and the right elevation plate is located in a space provided between the front and rear footings.

5. The juvenile seat of claim 3, wherein the seat base further includes a fixed spring anchor wall arranged to lie in spaced-apart relation to the right elevation plate, the right base retainer includes a movable retainer latch and spring means acting on the fixed spring anchor wall for yieldably urging the movable retainer latch normally toward the right elevation plate to extend into one of the lower and upper anchor sockets upon movement of the seat base relative to the right pillar to align the movable retainer latch in confronting relation to said one of the lower and upper anchor sockets.

6. The juvenile seat of claim 3, wherein the right elevation plate is also formed to include a travel channel arranged to intersect the lower and upper anchor sockets and the right-side lock further includes a right retainer-actuator button located outside of the right pillar-receiving chamber and arranged to extend through the travel channel to mate with the right base retainer to provide means for moving the right base retainer relative to the right elevation plate to engage and disengage the anchor sockets formed in the right elevation plate.

7. The juvenile seat of claim 2, wherein the left-side and right-side locks are separated from one another and configured to be operated independently from another.

8. The juvenile seat of claim 2, wherein the left-side lock includes a left elevation plate formed to include at least two anchor sockets and a left base retainer mounted for movement relative to the seat base toward and away from the at least two anchor sockets formed in the left elevation plate and configured to mate with one of the anchor sockets formed in the left elevation plate at a time to establish the desired elevation of the seat bottom relative to the underlying surface.

9. The juvenile seat of claim 8, wherein the right-side lock includes a right elevation plate formed to include at least two anchor slots and arranged to lie in spaced-apart confronting relation to the left elevation plate and a right base retainer mounted for movement relative to the seat base toward and away from the at least two anchor sockets formed in the right elevation plate at a time to establish the desired elevation of the seat bottom relative to the underlying surface.

10. The juvenile seat of claim 9, wherein the left base retainer is arranged to move relative to the seat base in a first direction to mate with one of the anchor sockets formed in the left elevation plate and the right base retainer is arranged to move relative to the seat base in an opposite second direction to mate with one of the anchor sockets formed in the right elevation plate.

11. The juvenile seat of claim 1, wherein the right pillar is formed to include lower and upper anchor sockets situated in the right pillar-receiving chamber and arranged to open in a direction facing toward the left pillar and the lock means includes a right-side lock arranged to extend through the right pillar-receiving chamber into the lower anchor socket to link the seat base to the right pillar to support the seat bottom at a first elevation above the underlying surface and alternately into the upper anchor socket to link the seat base to the right pillar to support the seat bottom at a higher second elevation above the underlying surface.

12. The juvenile seat of claim 11, wherein a portion of the right-side lock is arranged to lie under the seat bottom.

13. The juvenile seat of claim 11, wherein the left pillar is formed to include lower and upper anchor sockets situated in the left pillar-receiving chamber and arranged to open in a direction facing toward the right pillar and the lock means includes a left-side lock arranged to extend through the left pillar-receiving chamber into the lower anchor socket to link the seat base to the left pillar to support the seat bottom at a first elevation above the underlying surface and alternately into the upper anchor socket to link the seat base to the left pillar to support the seat bottom at a higher second elevation above the underlying surface.

14. The juvenile seat of claim 11, wherein the right pillar is formed to include a travel channel arranged to intersect the lower and upper anchor sockets and the right-side lock includes a right base retainer mounted for movement relative to the seat bottom to extend into a selected one of the lower and upper anchor sockets and a right retainer-actuator button located outside the right pillar-receiving chamber and arranged to extend through the travel channel to mate with the right base retainer to provide means for moving the right base retainer relative to the right pillar to engage and disengage the lower and upper anchor sockets.

15. The juvenile seat of claim 14, wherein the right base retainer includes a movable retainer latch coupled to the right retainer-actuated button and spring means for yieldably urging the movable retainer latch normally into one of the lower and upper anchor sockets upon movement of the seat base relative to the right pillar to align the movable retainer latch in confronting relation to said one of the lower and upper anchor sockets.

16. The juvenile seat of claim 11, wherein the right-side lock includes a movable retainer latch arranged to lie under the seat bottom and spring means for yieldably urging the movable retainer latch normally into one of the lower and upper anchor sockets upon movement of the seat base relative to the right pillar to align the movable retainer latch in confronting relation to said one of the lower and upper anchor sockets and the spring means is located under the seat bottom and outside of the right pillar-receiving chamber.

17. The juvenile seat of claim 1 wherein the right inner wall includes a guide rail arranged to extend into the right pillar-receiving chamber and the right pillar is formed to include channel means for receiving the guide rail therein during up-and-down movement of the seat base relative to the right pillar.

18. The juvenile seat of claim 1, wherein the right side wall includes a guide rail arranged to extend into the right pillar-receiving chamber and the right pillar is formed to include channel means for receiving the guide rail therein during up-and-down movement of the seat base relative to the right pillar.

* * * * *